United States Patent [19]

McCleary

[11] Patent Number: 4,811,637

[45] Date of Patent: Mar. 14, 1989

[54] PROTECTION DEVICE FOR HAND WRENCHES

[76] Inventor: Ronald T. McCleary, 15 Indian Springs Rd., Clementon, N.J. 08021

[21] Appl. No.: 192,939

[22] Filed: May 12, 1988

[51] Int. Cl.[4] ..... B25B 13/00

[52] U.S. Cl. ..... 81/177.2; 81/489; 16/114 R; 16/116 R

[58] Field of Search ..... 81/177.1, 177.2, 177.6, 81/489, 900, DIG. 1; 16/114 R, 116 R, DIG. 12, DIG. 19

[56] References Cited

U.S. PATENT DOCUMENTS

| | | | |
|---|---|---|---|
| D. 196,268 | 9/1963 | Lamb | D54/13 |
| 1,161,270 | 11/1915 | Vance . | |
| 1,371,533 | 3/1921 | Wright | 81/177.2 |
| 1,463,077 | 7/1923 | Gandell | 81/177.2 |
| 1,511,738 | 10/1924 | Lownsbery | 81/177.2 |
| 1,632,227 | 6/1927 | Halsey . | |
| 1,689,639 | 10/1928 | Neff | 81/177.2 |
| 1,965,354 | 7/1934 | Patock | 16/114 |
| 2,884,969 | 5/1959 | Lay | 145/29 |
| 3,072,955 | 1/1963 | Mitchell | 16/114 |
| 3,185,001 | 5/1965 | Viator | 81/177 |
| 3,706,154 | 12/1972 | Luebbers et al. | 43/53.5 |
| 4,197,611 | 4/1980 | Bell et al. | 16/116 R |
| 4,327,465 | 5/1982 | Moritsch | 29/80 |

FOREIGN PATENT DOCUMENTS

| | | |
|---|---|---|
| 422518 | 6/1947 | Italy . |
| 2182252 | 5/1987 | United Kingdom . |

*Primary Examiner*—Frederick R. Schmidt
*Assistant Examiner*—Lawrence Cruz
*Attorney, Agent, or Firm*—Thomas A. Lennox

[57] ABSTRACT

A detachable hand protection device constructed of a elastomeric polymeric composition interfits over one or both ends of hand wrenches of either open ended or closed ended configuration having a hexagonal longitudinal opening through the length of the body of the jacket to grip the wrench body member from the sides with a "V" shaped wall surface from each side and having openings through the top and the bottom of the jacket allowing the wrench end being held to be switched around and engage a nut or bolt head while the device is in place and having an end wall of reduced thickness to stretch over a wide range of sized wrenches.

12 Claims, 2 Drawing Sheets

PROTECTION DEVICE FOR HAND WRENCHES

BACKGROUND OF THE INVENTION

This invention involves a protection device to facilitate hand gripping of hand wrenches.

Despite the proliferation of socket wrenches operated by hand or mechanical means, one of the most popular tools is the simple hand wrench. The standard hand wrench has either two closed ends, two open ends, or the most common wrench having a closed end at one end at an open end at the other end, each capable of engaging nuts or bolt heads to turn them or hold them in place.

For the person who uses these wrenches only occasionally, a lengthy session of use usually results in sore hands, particularly in the base of the palm of the hand where the end of the wrench rests as torque is applied when using the wrench. It is usually not feasible to wear gloves while working with this type of tool since it is usually necessary to pick up small bolts or nuts and thread them onto each other. Without protection, sore hands are inevitable. For the skilled mechanic, sore hands result not from a single session but rather continuous day in and day out pressure to the base of the palm resulting in inflammation and discomfort as a result of regular continuous contact. Some possible conditions that arise from continuous pressure and hard use actually result in the wearing down of the bone or ligament exposing nerve channels to damage. Certain types of arthritis are exasperated by such hard use. Since the hand wrench tends to abut the same part of the palm each time torque is applied, the tool is particularly damaging. There is clearly a need to protect the hands particularly from the open end of the wrench when the closed end is being applied to the nut or bolt head. The edges are somewhat sharp and pointed. For the mechanic, it is common to wrap a rag around the wrench end, particularly when the open ended end is bearing into the palm of the user for a considerable period of time. However, rags are a safety hazard,d particularly when they are being used around moving equipment and they must be constantly rewound, adjusted and removed in order to maintain the proper protection. Other types of grips are not only not designed to safety these needs abut are inappropriate and do not attain the objects described hereinbelow.

SUMMARY OF THE INVENTION

It is an object of the present invention to provide an attachable and detachable protection device to interfit over hand wrenches which can be pulled off when not in use and switched from end to end to easily interfit over the end of the wrench to be gripped.

It is an additional object of the present invention to provide a detachable protection device to interfit over one end of a hand wrench to reduce point pressure on the hand, reduce soreness, and thus tend to increase the person's ability to grip the wrench and to protect the person's hand through extensive use of the wrench.

It is a further object of the present invention to provide a detachable hand protection grip which will interfit over one end of a hand wrench in order to use the unprotected end. If the protected end is to be intermittently used, the grip need not be removed in order to use the protected end of the hand wrench to engage a bolt head or nut.

It is an additional object of the present invention to provide a detachable hand grip, which when two of them are used, will interfit over both ends of the hand wrench allowing each end to be gripped and the opposite end used to engage a nut or bolt head, allowing the person to switch back and forth from one end of the wrench and yet have the hand protected.

It is a particular object of the present invention to provide a hand protection device to interfit over hand wrenches which will grip the wrench body members despite variances in size and shape of the body members of a wrench set and from one set of wrenches to another.

If is a particular object of the present invention to have a detachable hand protection grip that compensates for a wide variety of styles and sizes of various wrench designs.

It is a further object of the present invention to provide a detachable hand protection device to interfit on hand wrenches to grip the wrench end and resist the protection device from spinning off the wrench when high torque is applied to the wrench by the hand holding hand protection grip.

It is particular object of the present invention to provide a detachable protection gripping device which will interfit over a wide range of wrench sizes wherein the device stretches over the shape, radius, contour, cant and angle of the wrench end, even if it be an open ended wrench and yet also collapse comfortably around a closed end wrench end.

The invention is an attachable and detachable hand protection device to interfit on hand wrenches having nut or bolt head engaging means on each end of a wrench body member to engage either a nut or a bolt head, having a top, a bottom and two sides. The device includes an integral compressible resilient molding including a jacket enclosing a sufficient portion of the wrench body provide a grip for the hand. The jacket further includes a bottom wall member enclosing and opposed to the bottom of the wrench body member, two side wall members extending upwardly from the bottom wall each having interior opposing wall surfaces of sufficient size and shape to grip the sides of the wrench body member, and a top wall member partially enclosing the wrench body member top having a longitudinally cut slot opening of sufficient size and shape to receive and release the wrench body member. The device further includes two side wall extension members, one each extending longitudinally from a side wall member of a size and shape to extend to an outer end of the nut or bolt head engaging means covering the side edges of that nut or bolt head engaging means. The device further includes an end wall connecting the side wall members proximate to and covering the end of the nut or bolt head engaging means. It is preferred that the end wall is of a size and shape sufficient to stretch over the end of the nut or bolt head engaging means. It is further preferred that the end wall is of reduced thickness from the thickness of the side walls. It is preferred that the device include a wrench body gripping means including interior wall surfaces of the side walls of a shape to grip a wide variety of body shapes and sizes. It is preferred that the interior wall surfaces be opposed "V" shaped wall surfaces having the "V" shaped opening toward the interior of the jacket. It is preferred that the space between the end wall and the top wall and the distance between the end wall and the bottom wall is unobstructed and of sufficient size and shape to not significantly interfere with the use of partially covered wrench end to engage nuts or bolt heads.

DESCRIPTION OF PREFERRED EMBODIMENT

Figure 1:
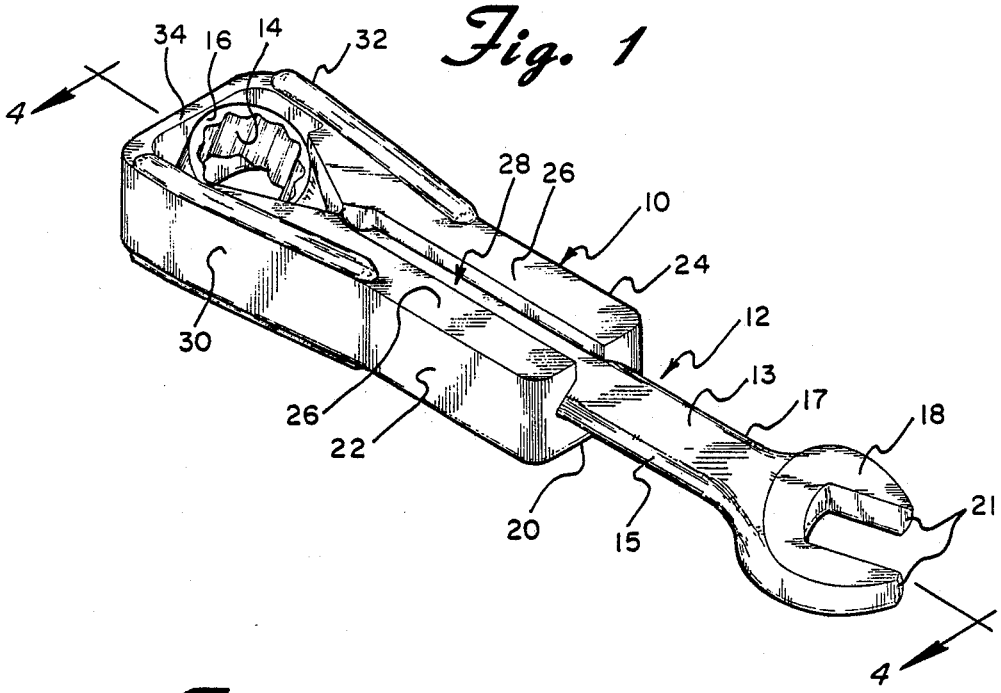
FIG. 1 is a perspective view of a protection device of the present invention interfitted over the end of a hand wrench.
Figure 2:
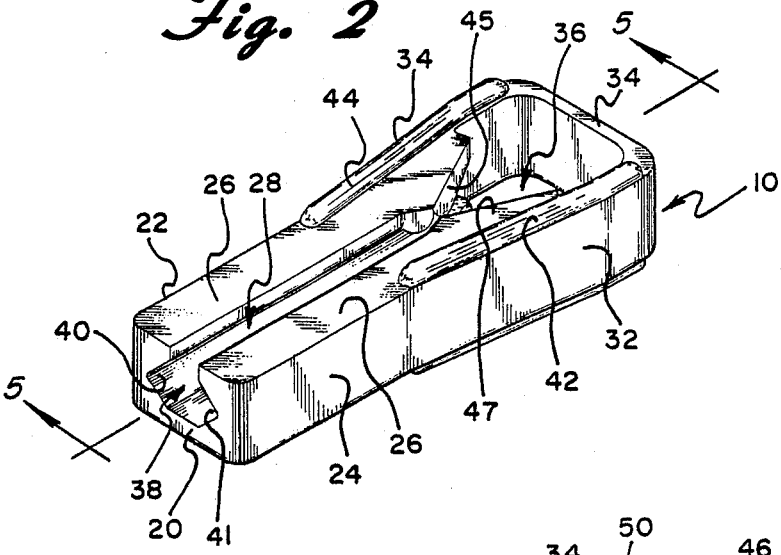
FIG. 2 is a perspective view, looking from the top of the device illustrated in FIG. 1.

In FIG. 1, hand protection device 10 is jacketed on closed box end 14 of wrench 12 and the body of the wrench which includes top 13, sides 15 and 17 and bottom 19, the latter being hidden in this view. Wrench 12 is a typical hand wrench having closed box end 14 terminating at end 16 and open ended socket 18 terminating at ends 20. Device 10 may be interfitted over either end of the wrench. While device 10 is illustrated in FIG. 1 as interfitted over closed end 14 in order to more effectively use open ended socket 18, the wrench may still be used to engage closed socket 14 over a nut or bolt to turn it or hold it in place. In addition, two devices 10 may be interfitted over both ends of a single wrench at the same time and both ends are still usable. Device 10 includes bottom wall 20, side walls 22 and 24 and top wall 26 which is split longitudinally by slot 28 which allows the body of wrench 12 to be interfitted into the jacket. Extending longitudinally toward the end of wrench 12 being protected are side wall extensions 30 and 32 extending from side walls 22 and 24 respectively. End wall 34 connects the ends of side wall extensions 30 and 32 proximate end 16 of wrench 12. In FIG. 2, with wrench 12 removed, opening 36 is displayed which is formed by not extending top 26 all the way to end 34 which connects edge extensions 32 and 34. Top wall 26 terminates at edges 45 and 47 which together form a "V" shape to open up opening 36 to slot 28. Slot 28 continues and opens directly into opening 36 to allow easy insertion and removal of wrench 12. Opening 38 is the horizontal opening and continuing longitudinally as the interior of the jacket which is formed by the walls just described above. In general, the vertical crosssectional view of opening 38 is hexagonal with one flat surface being the interior surface of bottom wall 20 and the top surface opening to slot 28. The interior surfaces of side walls 22 and 24 are of a vertically positioned "V" shaped surface with each surface opening to the inside and the pointed end of the "V" shape pointed outwardly from interior spacing opening 38. Surfaces 40 and 41 effectively grip sides 15 and 16 of the body of wrench 12. The interior surfaces of side wall extensions 32 and 34 abut the sides of the nut or bolt head engaging means of wrench 12 jacketed by device 10. End wall 34 abuts and opposes end 16 and any other end of a wrench, whether it be opened ended or closed ended. When the wrench is open ended, end wall 34 tends to be stretched more tightly over that end and effectively grips the wrench. The wall thickness of end wall 34 is reduced and with the ductility of the elastomeric, resilient molding material of device 10, it can easily accommodate a wide range of wrench sizes, shapes, contours and cants. Raised ribs 42 and 44 extending on the upper edges of side wall extensions 32 and 34 respectively, facilitate the hand grip and reduce inadvertent sliding of the hand hold, even if device 10 is covered with oil or grease.

Device 10 is a single integral molding of a polymeric elastomeric foam or rubber compound having resilience as well as preferred compressibility sufficient to allow the hand grip to force the jacket into and around the configurations of the particular wrench end being held. Suitable compositions are neoprene rubber either in a solid or foamed form as well as a variety of additional rubber compounds, natural or synthetic. Neoprene rubber with a Durometer reading of about 45 is most preferred with a preferred range of 40–60 and a more preferred rand of 42–50. Synthetic elastomers such as urethane polymers and like materials may also be used to mold device 10.

The dimensions of device 10 may vary widely depending upon the particular size and shape of wrench to be held. However, a single shape and size grips a wide range of wrenches from many manufacturers whether the wrench be closed end at both ends, partially closed ended, open ended at both ends or a combination of these nut or bolt engaging ends. A typical size and shape or device 10 is a length of about 4 to 4½ inches. It is preferred that the device be about one-half the total length of the wrench such that two devices may be interfitted over one wrench at the same time to allow the wrench to be switched back and forth to be used at either end without having to switch the grip. However, it is so easy to disattach and reattach protection device 10 from wrench to wrench, one device can be used on almost a whole set of wrenches. A preferred distance from point to point between the inside surfaces 40 and 41 is about 0.7 inch with the height of opening 38 to be about ⅜ inch. Side wall extensions 30 and 32 are about 3/16 inch thick but end wall 34 is preferably about 0.04 to about 0.05 inch thick allowing it to stretch more easily to accommodate to varying sizes, shapes, cants and angles of wrench ends. The height of device 12 is about 0.6 to about 0.76 inch which is sufficient to accommodate and cover the edges of most hand wretches, even if they are angled and canted substantially. Slot opening 28 is about 0.3 to about 0.4 inches wide which easily allows wrench 12 to be inserted and removed easily from device 10.

Figure 3:
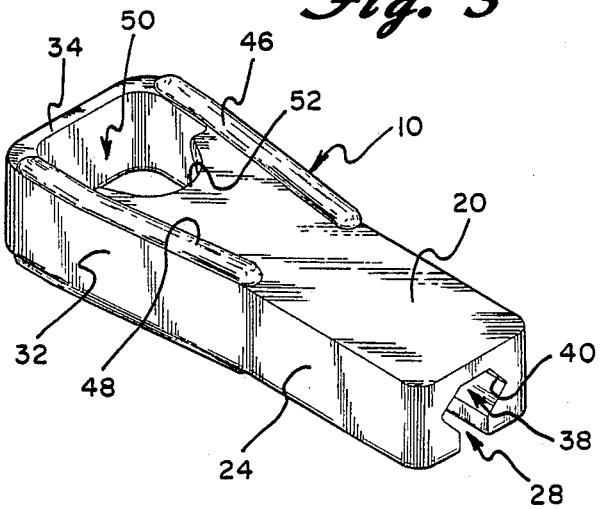
FIG. 3 is a perspective view looking at the bottom of the device illustrated in FIG. 1.
Figure 4:
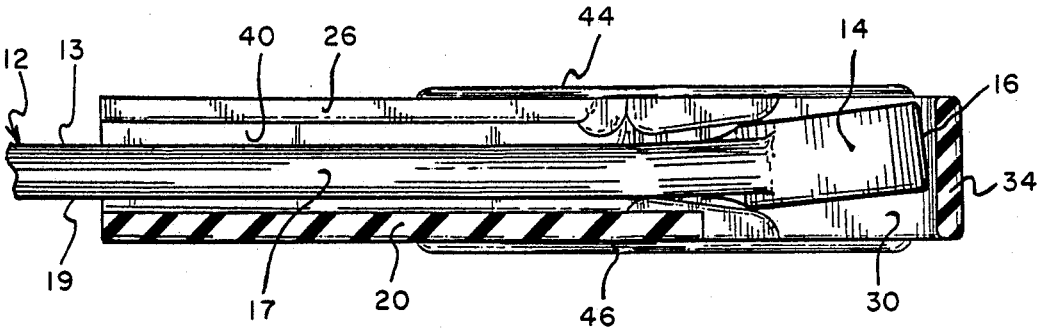
FIG. 4 is a vertical cross-sectional view taken along lines 4—4 of FIG. 1.
Figure 5:
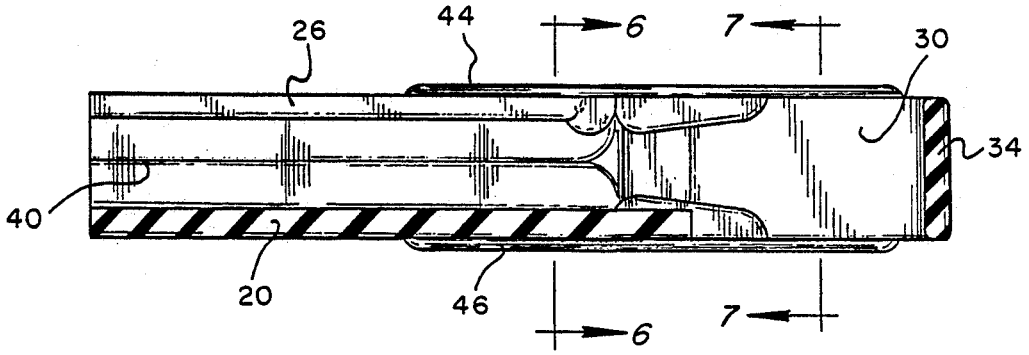
FIG. 5 is a vertical cross-sectional view taken along lines 5—5 of FIG. 2.
Figure 6:
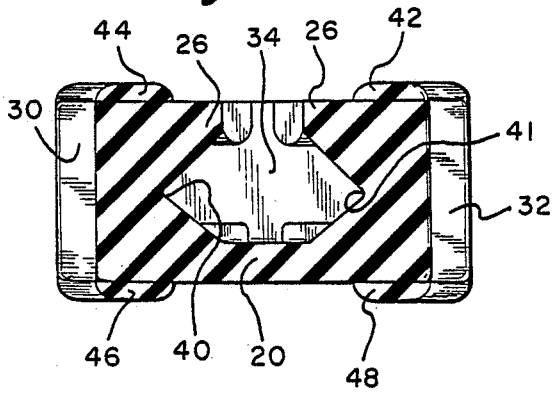
FIG. 6 is a vertical cross-sectional view taken along lines 6—6 of FIG. 5.
Figure 7:
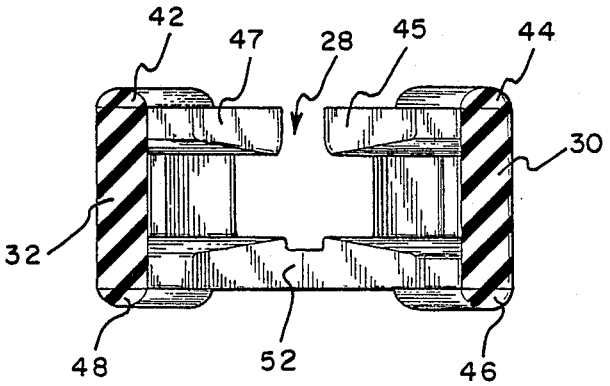
FIG. 7 is a vertical cross-sectional view taken along lines 7—7 of FIG. 5.

In FIG. 3, bottom wall 20 is in full view with raised ribs 46 and 48 extending above side wall extension 30 and 32 respectively, again to facilitate the hand grip of device 10. Opening 50 is formed by terminating bottom wall 20 at semicircular cut-out 52 before it reaches end wall 34. Thus, a substantial portion of side wall extension 30 and 32 terminate at upper edges and do not connect to bottom wall 20. Space 50 allows the engagement of the wrench end nut or bolt engaging means of wrench 12 to be utilized while device 10 is covering that end of the wrench. In FIG. 4, wrench 12 is seen jacketed by device 10 with end 16 abutting the inside surface of end wall 34. Side 15 of wrench 12 is gripped by inside surface 40 holding the wrench in place and allowing it to be gripped and securely held by the hand. The inside surface of bottom wall 20 abuts bottom surface 19 of wrench 12. FIG. 5, provides a cross-sectional view which facilitates the cross-sectional views of FIGS. 6 and 7 illustrating the inside surfaces of side wall extension 30 and side wall surface 40. FIG. 6 is particularly effective in illustrating how inside surfaces 40 and 41 are of a "V" shaped configuration gripping essentially any size wrench body which are usually rounded and may be a variety of shapes, all of which effectively are gripped by the "v" shaped wall.

FIG. 7 illustrates open slot 28 which extends the entire longitudinal distance cutting top wall 26 into two parts and the termination of opening 36 in angled edges 45 and 47 terminating top wall 26 as well as semi-circular edge 52 terminating bottom wall 20 so as to open up opening 50.

While this invention has been described with reference to the specific embodiments disclosed herein, it is not confined to the details set forth and the patent is intended to include modifications and changes which may come within and extend from the following claims.

I claim:

1. A detachable hand protection device to interfit on hand wrenches having nut or bolt head engaging means to engage either a nut or bolt head on each end of a wrench body member having a top, a bottom, and two sides, the device comprising an integral elastomeric molding comprising:

(a) a jacket enclosing a sufficient portion of the wrench body provide a grip for the hand comprising:
  (i) a bottom wall member enclosing and opposed to the bottom of the wrench body member,
  (ii) two side wall members extending upwardly from the bottom wall having interior opposing wall surfaces of sufficient size and shape to grip the sides of the wrench body member, and
  (iii) a top wall member partially enclosing the wrench body member top having a longitudinally cut slot opening of sufficient size and shape to receive and release the wrench body member,
(b) two side wall extension members, one each extending longitudinally from a side wall member of a size and shape to extend to an outer end of the nut or bolt head engaging means covering the side edges of that nut or bolt head engaging means, and
(c) and end wall connecting the side wall members proximate to and covering the end of the nut or bolt head engaging means.

2. The device of claim 1 wherein the end wall is of a size and shape sufficient to stretch over the end of the nut or bolt head head engaging means.

3. The device of claim 1 wherein the end wall is of reduced thickness from the thickness of the side walls.

4. The device of claim 1 comprising a wrench body gripping means comprising interior wall surfaces that are opposed "V" shaped wall surfaces having the 'V' shaped opening toward the interior of the jacket.

5. The device of claim 1 wherein space between the end wall and the top wall and space between the end wall and the bottom wall is unobstructed and of sufficient size and shape to not significantly interfere with the use of the partially covered wrench end to engage nuts or bolt heads.

6. The device of claim 1 wherein a transverse cross-section of the jacket has an interior opening in a hexagonal shape with a flat side of the hexagonal shape abutting the bottom of the wrench body member.

7. The device of claim 6 wherein the hexagonal opening of the transverse cross-section has a bottom and a top that are longer in length than the other sides.

8. A detachable hand protection device to interfit on hand wrenches having nut or bolt head engaging means to engage either a nut or a bolt head on each end of a wrench body member having a top, a bottom, and two sides, the device comprising an integral elastomeric molding comprising:

(a) a jacket enclosing a sufficient portion of the wrench body provide a grip for the hand comprising:
  (i) a bottom wall member enclosing and opposed to the bottom of the wrench body member,
  (ii) two side wall members extending upwardly from the bottom wall having interior "V" shaped opposing wall surfaces having the "V" shaped opening toward the interior of the jacket, the surfaces being of sufficient size and shape to grip the sides of the wrench body member, and
  (iii) a top wall member partially enclosing the wrench body member top having a longitudinally cut slot opening of sufficient size and shape to receive and release the wrench body member,
(b) two side wall extension members, one each extending longitudinally from a side wall member of a size and shape to extend to an outer end of the nut or bolt head engaging means covering the side edges of that nut or bolt head engaging means, and
(c) an end wall connecting the side wall members proximate to and covering the end of the nut or bolt head engaging means, wherein the end wall is of a size and shape sufficient to stretch over the end of the nut or bolt head head engaging means, wherein space between the end wall and the top wall and space between the end wall and the bottom wall is unobstructed and of sufficient size and shape to not significantly interfere with the use of the partially covered wrench end to engage nuts or bolt heads.

9. The device of claim 8 wherein a transverse cross-section of the jacket has an interior opening in a hexagonal shape with a flat side of the hexagonal shape abutting the bottom of the wrench body member.

10. The device of claim 9 wherein the hexagonal opening of the transverse cross-section has a bottom and a top that are longer in length than the other sides.

11. A detachable hand protection device to interfit on hand wrenches having nut or bolt head engaging means to engage either a nut or bolt head on each end of a wrench body member having a top, a bottom, and two sides, the device comprising an integral elastomeric molding comprising:

(a) a jacket enclosing a sufficient portion of the wrench body provided a grip for the hand comprising:
  (i) a bottom wall member enclosing and opposed to the bottom of the wrench body member,
  (ii) two side wall members extending upwardly from the bottom wall having interior opposing wall surfaces, the surfaces being of sufficient size and shape to grip the sides of the wrench body member, and
  (ii) a top wall member partially enclosing the wrench body member top having a longitudinally cut slot opening of sufficient size and shape to receive and release the wrench body member, (b) two side wall extension members, one each extending longitudinally from a side wall member of a size and shape to extend to an outer end of the nut or bolt head engaging means covering the side edges of that nut or bolt head engaging means, and (c) an end wall connecting the side wall members proximate to and covering the end of the nut or bolt head engaging means, wherein the end wall is of a size and shape sufficient to stretch over the end of the nut or bolt head head engaging means, wherein space between the end wall and the of wall and space between the end wall and the bottom wall is unobstructed and of sufficient size and shape to not significantly interfere with the use of the partially covered wrench end to engage nuts or bolt heads, wherein a transverse cross-section of the jacket has an interior opening in a hexagonal shape with a flat side of the hexagonal shape abutting the bottom of the wrench body member.

12. The device of claim 11 wherein the hexagonal opening of the transverse cross-section has a bottom and a top that are longer in length than the other sides.

* * * * *